US006994188B2

(12) United States Patent
Hockensmith

(10) Patent No.: US 6,994,188 B2
(45) Date of Patent: Feb. 7, 2006

(54) LADDER SUPPORT ATTACHMENT

(76) Inventor: Mark Victor Hockensmith, 3321 McCracken Pike, Versailles, KY (US) 40383

( * ) Notice: Subject to any disclaimer, the term of this patent is extended or adjusted under 35 U.S.C. 154(b) by 81 days.

(21) Appl. No.: 10/292,241

(22) Filed: Nov. 12, 2002

(65) Prior Publication Data

US 2004/0089501 A1 May 13, 2004

(51) Int. Cl.
*E06C 7/06* (2006.01)
*E06C 7/14* (2006.01)
*E04G 5/02* (2006.01)

(52) U.S. Cl. ..... 182/214; 182/107; 248/211

(58) Field of Classification Search ..... 182/107, 182/214, 129, 206, 230, 121, 209; 248/210, 248/211, 238

See application file for complete search history.

(56) References Cited

U.S. PATENT DOCUMENTS

| | | | | |
|---|---|---|---|---|
| 3,568,801 A | | 3/1971 | Werner | |
| 4,311,207 A | | 1/1982 | Lurry | |
| 4,331,217 A | | 5/1982 | Stecklow | |
| 4,369,860 A | | 1/1983 | Beane | |
| 4,394,887 A | | 7/1983 | Spinks | |
| 4,502,566 A | | 3/1985 | Wing | |
| 4,519,477 A | | 5/1985 | Ralston | |
| 4,615,412 A | | 10/1986 | Clarke | |
| 4,823,912 A | | 4/1989 | Gould et al. | |
| 4,938,312 A | | 7/1990 | Trail | |
| 5,010,979 A | | 4/1991 | Shreve | |
| 5,012,895 A | | 5/1991 | Santos | |
| 5,121,814 A | | 6/1992 | Southern | |
| 5,165,501 A | | 11/1992 | Donahey | |
| 5,323,875 A | | 6/1994 | Kennett | |
| 5,323,912 A | | 6/1994 | Fan et al. | |
| 5,655,623 A | | 8/1997 | Skyba | |
| 5,779,001 A | | 7/1998 | Skyba | |
| 5,855,252 A | * | 1/1999 | Vrolyks | 182/214 |
| 5,881,838 A | | 3/1999 | Swanick, Jr. | |
| 5,890,560 A | * | 4/1999 | Sloop | 182/107 |
| 5,918,698 A | | 7/1999 | Lunn | |
| 5,931,259 A | | 8/1999 | Hoey | |
| 6,405,828 B1 | | 6/2002 | Redding | |
| 6,550,577 B1 | * | 4/2003 | Allgire | 182/107 |

* cited by examiner

*Primary Examiner*—Hugh B. Thompson, II

(57) ABSTRACT

A ladder support attachment having a support member, a stop member, and a pair of spaced legs therebetween. The legs terminate at one end in hooks or brackets that are placed over the rungs of a ladder. The attachment quickly and easily attaches to a ladder with no tools and spaces and stabilizes the ladder a predetermined distance from a structure.

10 Claims, 2 Drawing Sheets

LADDER SUPPORT ATTACHMENT

FIELD OF THE INVENTION

The present invention is related to a ladder support attachment that affixes quickly and easily to a rung of a ladder to stabilize the ladder and space it from a wall or other substantially vertical structure.

BACKGROUND

Ladder stabilizing devices or attachments are known in the art devices used to space a ladder from the wall of a structure and stabilize the ladder as it rests against the wall. The primary use of such devices is to permit additional work space away from the wall for a person climbing the ladder, as is often necessary when painting a wall, cleaning the gutters of a building, or using the ladder to climb on to a roof. Prior art stabilizing devices are also useful when attempting to work proximate fragile features of a structure, such as windows and gutters, because they allow these features to be accessed without having to rest the legs of the ladder directly thereon.

Prior art ladder support devices typically include unshaped support members that are supported in a fixed position on a ladder by means of brackets or clamps that are bolted or otherwise fastened to either the ladder legs or rungs. Many prior art devices utilize chains between the support members and the ladder to enhance the stability of the entire assembly. Furthermore, many utilize shaped brackets or channels that engage several rungs of the ladder to provide enhanced support. Some examples of prior art ladder support devices employing the above-referenced features can be found in U.S. Pat. Nos. 3,568,801, 4,331,217, 4,369,860, 4,502,566, 4,615,412, 4,823,912 and 5,010,979.

The aforementioned ladder support devices all accomplish the objective of spacing a ladder from a vertical surface in some fashion, but generally suffer from complexity of design, use and manufacture. Prior art ladder support devices are difficult or impossible to quickly attach to or detach from a ladder, often involve numerous fasteners that must be tightly secured prior to use, and provide support members that rest against the wall at a sub-optimal angle for safe use of the ladder. Furthermore, many of the prior art devices are expensive to manufacture thereby discouraging sales to the public.

SUMMARY OF THE INVENTION

The instant invention obviates the aforementioned problems by providing a ladder support attachment having an efficient simple design with no detachable parts that permits a user to quickly and easily attach the support to the ladder without the use of hand tools or other fasteners. The invention utilizes the load placed on the wall by the ladder to secure itself in place, and it's structure includes no supports or struts extending below the point of attachment of the support on the ladder, so that a support member may be positioned on the roof of a structure thereby facilitating safe access thereto.

Therefore, one object of the present invention is an improved ladder support attachment that may be secured to a ladder with a minimum of effort.

A further object of the invention is a ladder support attachment having no detachable parts thereby providing for ease of use.

A further object of the invention is a ladder support attachment having no detachable parts for ease of manufacture.

A further object of the invention is a ladder support attachment that utilizes the load placed on the wall by the latter to hold the support in place.

A further object of the invention is a ladder support attachment having a support member that may be rested on the roof of a structure.

Other objects and advantages of the instant invention will be apparent after reading the detailed description of the preferred embodiments, taken in conjunction with the accompanying drawing figures.

DETAILED DESCRIPTION OF THE PREFERRED EMBODIMENT(S)

Figure 1:
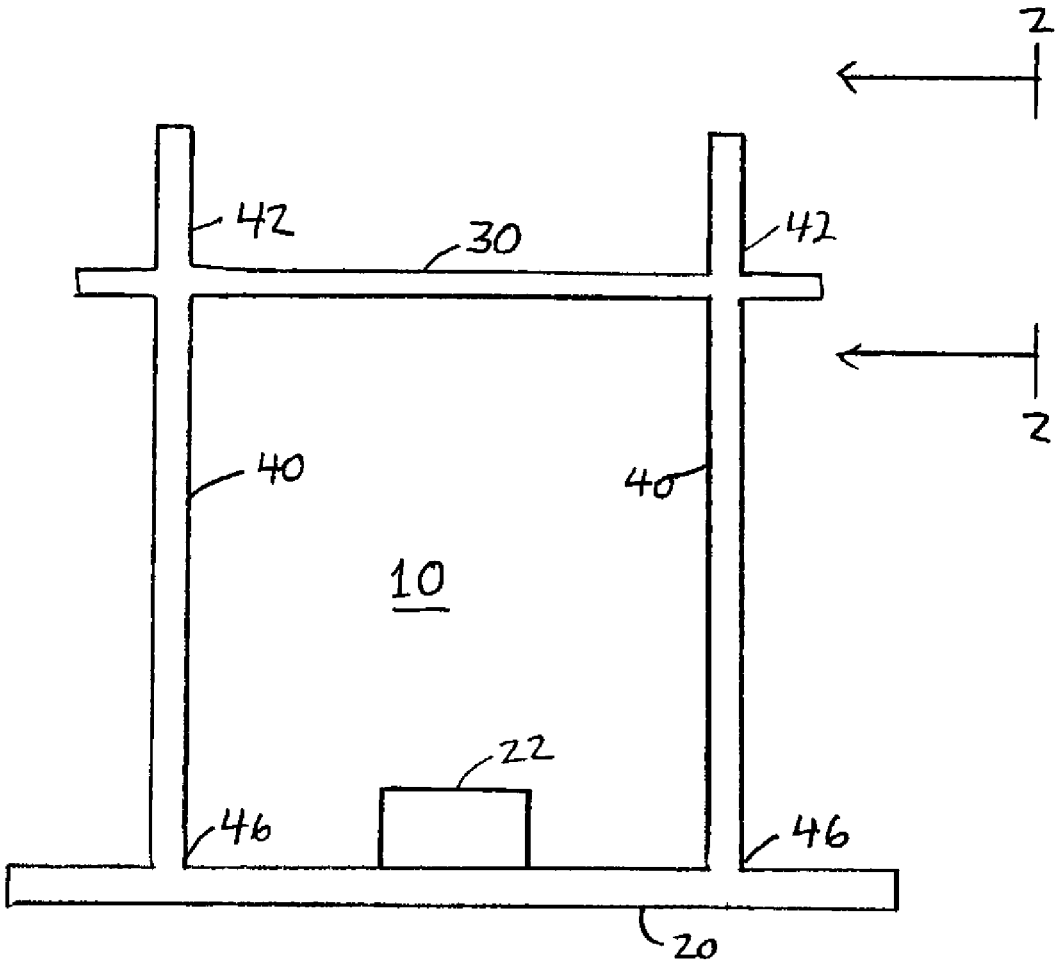
FIG. 1 is a plan view of the instant invention.
Figure 2:
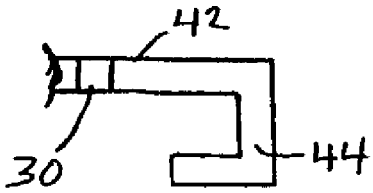
FIG. 2 is a view of the instant invention taken along the line 2—2 of FIG. 1.

Referring now to the drawing Figures, and in accordance with a preferred constructed embodiment of the instant invention, a ladder support attachment 10 for stabilizing a ladder 1 a predetermined distance from a vertical structure 5 includes a support member 20, a stop member 30, and a pair of spaced legs 40 that are secured to both the support member 20 and the stop member 30 at opposed ends thereof. The support member 20, stop member 30, and legs 40 may be made from any material possessing the necessary strength to support the ladder 1 and the concomitant load thereon when the ladder 1 is in use, such as aluminum or metal tubing or solid stock, plastic, reinforced fiberglass, carbon fiber, suitable hardwoods, etc. One of ordinary skill in the art will recognize that this list is representative of materials that may be used, and not exhaustive.

The support member 20 is preferably longer than the width of the legs (or rails) 2 of the ladder 1 to lend stability to the ladder 1 when the support member rests against a wall or other vertical structure 5. The stop member 30 is also longer than the width between the ladder legs 2 thereby permitting the stop member 30 to rest against the legs 2 when the support attachment 10 is in use. While the stop member as shown in the drawing figures is a unitary member, one of ordinary skill will appreciate that two stop members 20 may be utilized, one secured to and depending outwardly from each leg 40.

The support member 20 is arranged substantially parallel to and spaced from the stop member 30 and is secured thereto by the pair of legs 40. A first end 42 of each leg 40 terminates in a hook or bracket 44 that is shaped to engage a rung 3 of the ladder 1. Each leg 40 is secured proximate the first end 42 thereof to the stop member 30. A second end 46 of each leg 40 terminates at the support member 20. Note that the hooks 44 may be shaped to engage different ladder rung configurations. Where round rungs 3 are utilized, the hooks 44 may be arcuate in shape, while a bracket-type hook 44 may be used with square or flat rungs 3.

An adjustable tether 50 is secured at a first end 52 to the ladder rung 3, and at a second end 54 may be secured around the support member 20. The tether 50 may be fashioned from a length of chain with a suitable clasp or fastener at each end, or a length of webbing, rope, cable or other adjustable material. The tether 50 may be used to adjust the vertical position of the support member 20, as will be explained in further detail below.

Figure 3:
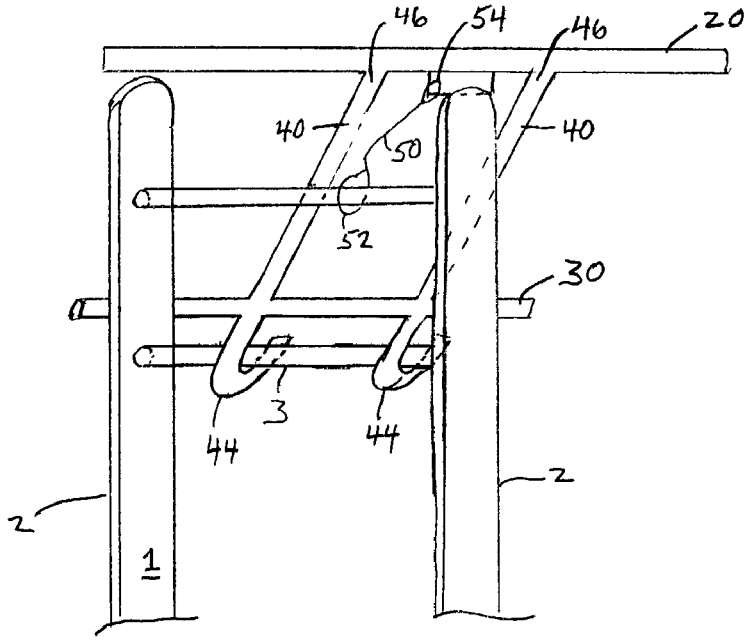
FIG. 3 is an isometric view of the invention secured to a ladder.
Figure 4:
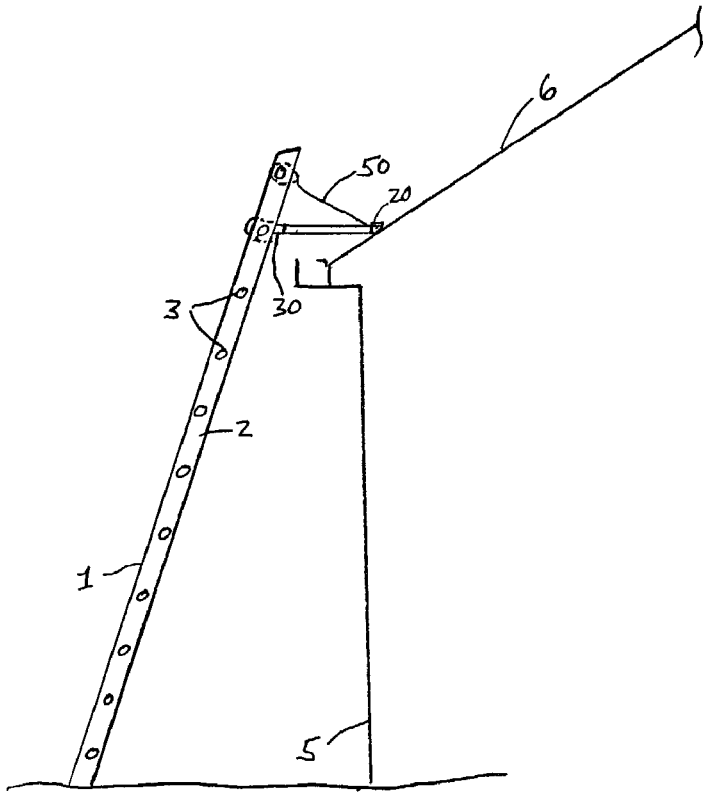
FIG. 4 is a side view of the invention secured to a ladder and resting against a structure.

In operation as best seen in FIGS. 3 and 4, the ladder support attachment 10 is secured to a ladder 1 by positioning the support member 20 below the rung 3 of the ladder 1 to which the ladder support attachment 10 will be secured, thence positioning the hooks 44 of each leg 40 over the rung 3. As best seen in FIG. 3, the support member 20 is then rotated upwardly, so that the stop member 30 is forced against the legs 2 of the ladder 1 until the support member 20 is substantially parallel to a plane defined by the ground. This feature of the instant invention permits the ladder 1 to be positioned at the optimal angle from the wall while simultaneously resting the weight of the ladder 1 against the stop member, thereby forcing the hooks 44 onto and against the ladder rung 3. Once the support member 20 is rested against a wall or other vertical structure 5, the ladder support attachment 10 is secured in place by the weight of the ladder 1 and any attendant load placed thereon. Thus the invention 10 is both extremely simple to use and safe.

The tether 50 may be used to hold the support member 20 in place as the ladder 1 is positioned on the wall 5. For example, a first end of the tether 52 may be attached to the rung 3 above the rung 3 on which the hooks 44 are attached while a second end thereof 54 is secured to the support member 30. The tether 50 is then adjusted such that the support member 20 is held vertically at a point where the stop member 30 contacts the legs 2 of the ladder 1. This feature of the invention 10 also enables a user to easily position the support member 20 on a rooftop 6 of a structure 5. Since the support member 20 is held away from the ladder 1 by only the legs 40, the support member 20 may be placed directly on the roof 6 of a structure 5 such that a user may readily access a gutter or the roof 6 itself.

In a preferred constructed embodiment of the instant invention, the legs 40 are secured to the stop member 30 a predetermined distance from the hooks 44 such that, when the support member 20 is positioned against a wall 5, the angle defined by the legs of the ladder 1 and the wall 5 is approximately 75½ degrees, pursuant to recommendations from the Occupational Safety and Health Administration. Stated another way, the distance between the hooks 44 and the stop member 30 is predetermined so that the ladder 1 is 15 degrees from the vertical when the support member 20 rests against the structure 5 and is substantially parallel to a horizontal plane defined by the ground.

In an alternative embodiment of the instant invention as best seen in FIG. 1 the ladder support attachment 10 further includes a handle 22 depending from the support member 20 for rotating the support member 20 upwardly when securing the attachment 10 to the ladder 1. Furthermore, the second end 54 of the adjustable tether 50 may be secured to the handle 22.

The foregoing detailed description of the preferred embodiments is considered as illustrative only of the principles of the invention. Since the instant invention is susceptible of numerous changes and modifications by those of ordinary skill in the art, the invention is not limited to the exact construction and operation shown and described, and accordingly, all such suitable changes or modifications in structure or operation which may be resorted to are intended to fall within the scope of the claimed invention.

I claim:

1. A ladder support attachment for spacing a ladder from a structure comprising:

a support member for contacting said structure and stabilizing said ladder;

a stop member for contacting legs of said ladder; and a pair of spaced legs each secured proximate a first end thereof to said stop member and secured at a second end thereof to said support member, each of said leg first ends terminating in a hook for engaging a rung of said ladder, an adjustable tether adapted to be secured at a first end to a rung of said ladder and adapted to be secured at a second end to said support member, and a handle depending from said support member for rotating the support member upwardly when securing said support attachment to said ladder.

2. A ladder support attachment as claimed in claim 1 wherein said stop member is adapted to be secured to the legs of the ladder a predetermined distance from the hooks of the legs of the ladder so that said ladder is approximately fifteen degrees from vertical when said support member rests against said structure.

3. A ladder support attachment as claimed in claim 1 wherein the length of said support member is greater than the width of the legs of said ladder.

4. A ladder support attachment as claimed in claim 1 wherein the length of said stop member is greater than the width of the legs of said ladder.

5. A ladder support attachment as claimed in claim 1 wherein the stop member is a unitary member.

6. A ladder support attachment as claimed in claim 1 wherein the stop member and support member are substantially parallel.

7. A ladder support attachment as claimed in claim 1 wherein the pair of spaced legs are substantially parallel to each other.

8. A ladder support attachment as claimed in claim 1 wherein the pair of spaced legs are transverse to said support member.

9. A ladder support attachment as claimed in claim 1 wherein the pair of spaced legs are transverse to said stop member.

10. A ladder support attachment as claimed in claim 1 wherein the pair of spaced legs are transverse to both said support member and said stop member.

* * * * *